US008783198B2

(12) United States Patent
Luo et al.

(10) Patent No.: US 8,783,198 B2
(45) Date of Patent: Jul. 22, 2014

(54) SPAR HULL BELLY STRAKE DESIGN AND INSTALLATION METHOD

(75) Inventors: Michael Y. H. Luo, Bellaire, TX (US); Harvey O. Mohr, Katy, TX (US); Vera Mohr, legal representative, Carmine, TX (US); Lixin Zhang, Sugar Land, TX (US); Kostas Filoktitis Lambrakos, Houston, TX (US)

(73) Assignee: Technip France, Courbevoie (FR)

( * ) Notice: Subject to any disclaimer, the term of this patent is extended or adjusted under 35 U.S.C. 154(b) by 298 days.

(21) Appl. No.: 13/147,256

(22) PCT Filed: Jan. 28, 2010

(86) PCT No.: PCT/US2010/022364

§ 371 (c)(1),
(2), (4) Date: Dec. 9, 2011

(87) PCT Pub. No.: WO2010/090942

PCT Pub. Date: Aug. 12, 2010

(65) Prior Publication Data

US 2012/0272888 A1 Nov. 1, 2012

Related U.S. Application Data

(63) Continuation-in-part of application No. 12/365,811, filed on Feb. 4, 2009, now abandoned.

(51) Int. Cl.
*F15D 1/10* (2006.01)

(52) U.S. Cl.
USPC ..... 114/243

(58) Field of Classification Search
USPC ..... 114/243
See application file for complete search history.

(56) References Cited

U.S. PATENT DOCUMENTS

| | | | |
|---|---|---|---|
| 3,360,810 | A | 1/1968 | Busking |
| 3,510,892 | A | 5/1970 | Monnereau et al. |
| 4,234,270 | A | 11/1980 | Gjerde et al. |
| 4,630,968 | A | 12/1986 | Berthet et al. |
| 4,683,832 | A | 8/1987 | Dysarz |
| 4,702,321 | A | 10/1987 | Horton |
| 4,739,957 | A | 4/1988 | Vess et al. |
| 4,740,109 | A | 4/1988 | Horton |
| 5,197,826 | A | 3/1993 | Korloo |

(Continued)

OTHER PUBLICATIONS

Gardel, A., International Search Report for International Patent Application No. PCT/US2010/022364, European Patent Office, dated Nov. 3, 2010.

(Continued)

*Primary Examiner* — Stephen Avila
(74) *Attorney, Agent, or Firm* — Locke Lord LLP

(57) ABSTRACT

A spar hull for a floating vessel can include a hard tank having a belly portion, a fixed strake coupled to the outer surface of the tank and a folding strake coupled to the belly portion of the tank, the folding strake having one or more strake panels and one or more support frames. A method for installing folding belly strakes on a spar hull may include providing a floating spar hull having a hard tank with a belly side, rotating the spar so that the belly side is in a first workable position, coupling at least one folding strake to the belly side of the spar, and coupling the strake in a folded position for transport. The method may include positioning the spar hull offshore in a transport position, upending the spar hull, unfolding the strake, fixing the strake in the unfolded position and installing the spar hull.

20 Claims, 16 Drawing Sheets

(56) References Cited

U.S. PATENT DOCUMENTS

| | | | |
|---|---|---|---|
| 5,230,213 | A | 7/1993 | Lawson |
| 5,443,330 | A | 8/1995 | Copple |
| 6,148,751 | A | 11/2000 | Brown et al. |
| 6,213,045 | B1 | 4/2001 | Gaber |
| 6,244,785 | B1 | 6/2001 | Richter et al. |
| 6,283,407 | B1 | 9/2001 | Hakenesch |
| 6,349,664 | B1 | 2/2002 | Brown et al. |
| 6,953,308 | B1 | 10/2005 | Horton |

OTHER PUBLICATIONS

Gardel, A., Written Opinion for International Patent Application No. PCT/US2010/022364, European Patent Office, dated Nov. 3, 2010.

SPAR HULL BELLY STRAKE DESIGN AND INSTALLATION METHOD

CROSS REFERENCE TO RELATED APPLICATIONS

This application is a National Stage application under 35 U.S.C. §371 of International Application No. PCT/US2010/022364, filed Jan. 28, 2010, which is a continuation-in-part of U.S. application Ser. No. 12/365,811, filed Feb. 4, 2009 now abandoned.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to oil and gas drilling and production equipment; and more specifically relate to an improved design and installation method for belly strakes useful for stabilizing floating, deep-water offshore oil and gas drilling and production platforms.

2. Description of the Related Art

Offshore oil and gas drilling and production operations can involve the provision of a vessel, or platform, sometimes called a rig, on which the drilling, production and storage equipment, together with the living quarters of the personnel manning the platform, if any, may be mounted. In general, offshore platforms fall into one of two classes, that is, "fixed" and "floating" platforms. Fixed platforms often comprise an equipment deck supported by legs that can be seated directly or indirectly on the sea floor. While relatively stable, they are typically limited to relatively shallow waters, e.g., depths of about 500 feet (approximately 152 m) and less. However, at least one so-called "compliant piled tower" (CPT) platform, which is referred to as the "Baldpate" tower, is said to be operating at a depth of 1648 ft. (approximately 500 m).

Floating platforms are typically employed in water depths of about 500 ft. (approximately 152 m) and greater, and may be held in position over the well site by, as examples, mooring lines anchored to the sea floor, motorized thrusters located on the sides of the platform or both. Although floating platforms may be more complex to operate because of their movement in response to environmental conditions, such as wind and water movement, they are generally capable of operating in substantially greater water depths than are fixed platforms. Floating platforms may also be more mobile, and hence, easier to move to other well sites. There are several different types of known floating platforms, such as, for example, so-called "drill ships," tension-leg platforms (TLPs), semi-submersibles, and spar platforms.

Spar platforms, for example, comprise long, slender, buoyant hulls that give them the appearance of a column, or spar, when floating in an upright, operating position, in which an upper portion extends above the waterline and a lower portion is submerged below it. Because of their relatively slender, elongated shape, they have relatively deeper drafts, and hence, substantially better heave characteristics, e.g., much longer natural periods in heave, than other types of platforms. Accordingly, spar platforms have been thought of by some as a relatively successful platform design over the years. Examples of spar-type floating platforms used for oil and gas exploration, drilling, production, storage, and gas flaring operations may be found in the patent literature in, e.g., U.S. Pat. No. 6,213,045 to Gaber; U.S. Pat. No. 5,443,330 to Copple; U.S. Pat. Nos. 5,197,826; 4,740,109 to Horton; U.S. Pat. No. 4,702,321 to Horton; U.S. Pat. No. 4,630,968 to Berthet et al.; U.S. Pat. No. 4,234,270 to Gjerde et al.; U.S. Pat. No. 3,510,892 to Monnereau et al.; and U.S. Pat. No. 3,360,810 to Busking.

Despite their relative success, spar-type platforms include some aspects that need improvement. For example, because of their elongated, slender shape, they can be relatively more complex to manage during offshore operations under some conditions than other types of platforms in terms of, for example, control over their trim and stability. In particular, because of their elongated, slender shape, spar platforms may be particularly susceptible to vortex-induced vibrations (VIV), which may result from strong water currents acting on the hull of the platform. The provision of apparatus on the elongated hulls for vortex breaking, or controlled vortex-shedding, can reduce or eliminate this problem. For example, U.S. Pat. Nos. 6,148,751 and 6,349,664, to Brown et al., describe a "system for reducing hydrodynamic drag and VIV" for fluid-submersed hulls. U.S. Pat. No. 6,244,785, to Richter et al., describes a "precast, modular spar system having a cylindrical open-ended spar." Such prior art helical strakes typically can comprise very heavy, helically-formed, edge-supported plates that must be attached, e.g., by welding, to the hull while it is being fabricated, is such as in a dry dock. Moreover, some spar may require belly strakes. When a spar has been built in a fabrication yard, three possibilities may typically be employed for bringing the spar to the offshore site. The first possibility may include towing the spar on the surface of the water, such as with tug boats, for a "wet tow" transport. In this case, the belly strakes may be installed around the hull if the draft of the hull plus the strake panel width does not exceed the yard and the ship channel water depth, normally 45 ft. (14 m). However, sometimes the draft in the yard and/or ship channel may be low, which may make it difficult or impossible to have the fully extended strakes around the hull. The second possibility may include towing the spar on a Heavy Lift Vessel ("HLV") for a "dry tow" transport. In this scenario, it may not be possible to install the full strakes around the hull, for example, because the hull may have to be maintained on the deck of the barge by a set of supports. Generally, then, the strakes may be installed around a portion of the hull, but not on the part of the hull maintained by the supports. When the barge arrives at the installation site, it may ballasted and the spar may be allowed to float on the surface of the water. The spar may be upended from the horizontal position to a vertical position, wherein finally the rest of the strakes may be installed on the hull. The third possibility may be a combination of the first two possibilities. First, the spar hull is dry transported using a HLV from a remote fabrication yard to a near fabrication yard. After float-off in a deep water pit, the final outfitting will be completed in a near fabrication yard. The final outfitting may include removal of dry tow transportation supports and aids, installation of remaining wet tow aids and lightweight survey of the hull. The hull will be wet towed to the offshore site. For a small diameter hull, the belly strakes can be installed in the quayside of the yard by rotating the spar hull. However, for a large diameter hull, the belly stake may need to be installed offshore due to the limited water depth of the ship channel, for example.

The inventions disclosed and taught herein are directed to an improved system and method for designing and installing a belly strake for a spar with a large diameter hull.

BRIEF SUMMARY OF THE INVENTION

A spar hull for a floating vessel may include a hard tank having an outer surface, which can include a belly portion, a fixed strake and a folding strake configured to be selectively folded toward the outer surface of the tank. The strakes can be coupled to any portion of the spar hull, such as the outer surface of the hard tank. The folding strake can have one or more strake panels, which can be coupled, such as for rotation, to one or more portions of the spar hull, for example, to a belly side. The folding strake can have one or more folded or unfolded positions and can include structure for locking the strake in one or more positions. The folding strake can include one or more strake panels and support frames, each of which can, but need not, be configured to be coupled, such as rotatably, to the side of the spar hull. In other embodiments, one or more support frames can be coupled to the side of the spar hull and the strake panels rotatably coupled to the support frames that collectively form a strake surface when the strake panels are unfolded. The panels and/or frames can have one or more folded or unfolded positions and the support frame can, but need not, be configured to support the strake panel, directly or otherwise, when the frame and/or panel are in one or more respective unfolded positions. A method for utilizing belly strakes on a spar hull for floating vessels can include providing a floating spar having a hard tank and a belly side, transporting the spar to a deep water pit, rotating the spar so that the belly side is in a first workable position, which can be any position, and coupling at least one folding strake to the belly side of the spar. The method may further include fixing the strake in a folded position, such as for transport or tow, and rotating the spar to a second position, such as for wet tow transport. The folding belly strake may include one or more frames and/or panels, which may be fitted or removed before transport or final positioning. The method may include unfolding one or more components of the strake and coupling those components in a position for operations, fixed or otherwise. One or more panels or frames may support one another when in the folded or unfolded position. A method of utilizing a spar hull for offshore oil and gas operations may include providing a spar hull having a belly strake, is wherein at least a portion of the belly strake has folded and unfolded positions, fixing the strake in the folded position, positioning the spar hull offshore in a transport position, upending the spar hull, unfolding the strake, fixing the strake in an unfolded position and positioning the spar hull in the installed position. Unfolding the strake may include unfolding one or more support frames and/or strake panels.

DETAILED DESCRIPTION

Figure 1:
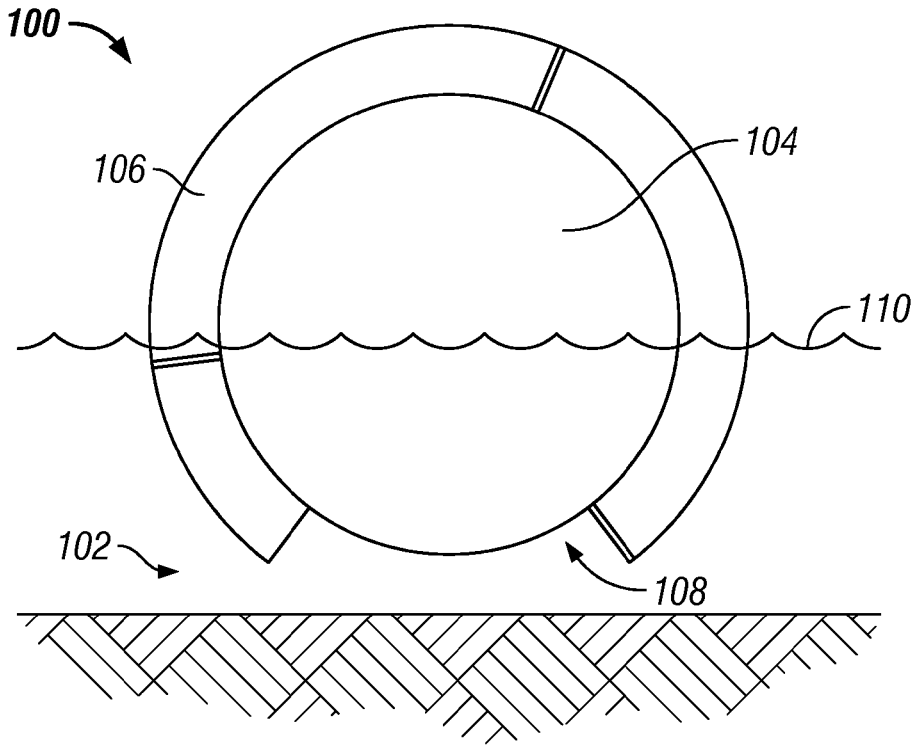
FIG. 1 illustrates an end view of one of many embodiments of a spar in a deep water pit and utilizing certain aspects of the present inventions.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Applicants have invented a belly strake system, design and installation method for a spar having a large diameter spar hull. The spar hull without the belly strake may be towed, for example, dry towed on a heavy lift vessel (HLV), from a fabrication yard to a float-off site. The spar hull can be off-loaded at the float-off site, for example, into a deep water-filled pit or tank (such as a 77 ft. (23 m) deep water pit in Kiewit Offshore Services yard, Texas, USA) for preparing or outfitting the spar hull for operations. The hull can be rolled about its longitudinal axis, for example, 180° with its bare belly side upward in the pit, for allowing access to a portion of the hull where a strake may be coupled thereto. A belly strake, such as a foldable strake, can be installed on the belly side in the quayside. The spar hull can be rolled back toward or to its original position with the strake and belly side toward the sea bed or other bottom of the deep water pit and towed to another site, such as its permanent site for operations. The tow can pass through a shallow water depth zone, such as a 45 ft. (14 m) deep channel, for example. Once the spar arrives at a location for operations, it can be upended. The strake panels can be unfolded and fixed in place, such as by installing fasteners to lock the strake panels into an unfolded position. One or more support frames can be utilized to support the strake panels, and in some embodiments, the support frames can be folded, as well.

The inventions disclosed and taught herein can be advantageous in numerous ways, as will be understood by one of ordinary skill having the benefit of the present disclosure. For example, the systems and methods described herein can reduce the time and costs associated with the installation and use of belly strakes on spar hulls. As other examples, installing the foldable strake panels on the quayside can reduce or eliminate offshore swage, grouting, or other steps, and the time and costs associate therewith. Another of many advantages of the present invention may include improvement of the dimension control associated with strakes or spar hulls. For example, in at least one embodiment, the present inventions can allow the folded support frames and/or folded strake panels to be unfolded in the yard, such as for is performing one or more system integration tests (SITs). Once the support frames are formed or fitted for the strake panels, for example, which can include installing fasteners, such as bolts and nuts, on the support frame, the strake supports and panels can be folded and temporarily coupled to the hull, such as with temporary sea fastening. This can allow, for example, the strake panels to be quickly and accurately installed on the strake support frame during offshore operations, which may help ensure safety and efficiency. As another example, the present inventions may eliminate the need for a lifting vessel for strake panel installation at the site of operations, such as the permanent rig site, which can significantly reduce operations costs. It is also contemplated that a remote operated vehicle (ROV) can be used to install fasteners and/or retainers, such as nuts onto the bolts of the support frame, to unfold the strakes, or to complete other tasks required by the present inventions, as will be further described herein.

FIG. 1 illustrates one of many embodiments of a spar 100 in a deep water pit 102 and utilizing certain aspects of the present inventions. Spar 100 can include a hull 104, such as a hard tank. Hull 104 can be made from any material required by a particular application and can preferably be formed from steel. Spar 100 can further include strake 106 on hull 104 for vortex breaking. Strake 106 can include any number of sections and any number of components, as will be further described below. Strake 106 can preferably be formed from steel, but can be made from any material in accordance with a particular application. Strake 106 can be coupled to hull 104 in any manner, such as, for example, by welding, bolts, hinges, or other couplers, separately or in combination, as will be understood by one of ordinary skill in the art. Also, strake 106 can be fixed in one position, which may be any position on any location of hull 104, or strake 106 can be dynamic, such as foldable, moveable, or otherwise. In at least one embodiment, which is but one of many, strake 106 can, but need not, be coupled along the longitudinal outside surface of hull 104, such as in a helical fashion. One or more portions of strake 106 can be coupled, for example, in a fixed manner to hull 104 at one or more locations required by a particular application. For example, the embodiment of FIG. 1 shows strake 106 coupled along certain portions of the outside surface of hull 104, wherein strake 106 is absent from certain other portions of hull 104, such as the belly side 108 of spar 100. As used herein, belly side 108 refers to the area of hull 104 that may face the ground during construction or transport. However, once spar 100 reaches its location for operations, which can, but need not be, its final working location, belly side 108 may also require strake 106 be coupled thereto in accordance with a particular application. While strake 106 can be coupled to the belly side 108 of spar 100 in the preparation position shown in FIG. 1, the time and expense of underwater fabrication can be avoided by one having the benefits of this disclosure. Also, the costs associated with fabrication at sea, such as, for example, at or near the location of operations of a particular embodiment, can be reduced or eliminated, as will be further described below.

Figure 2:
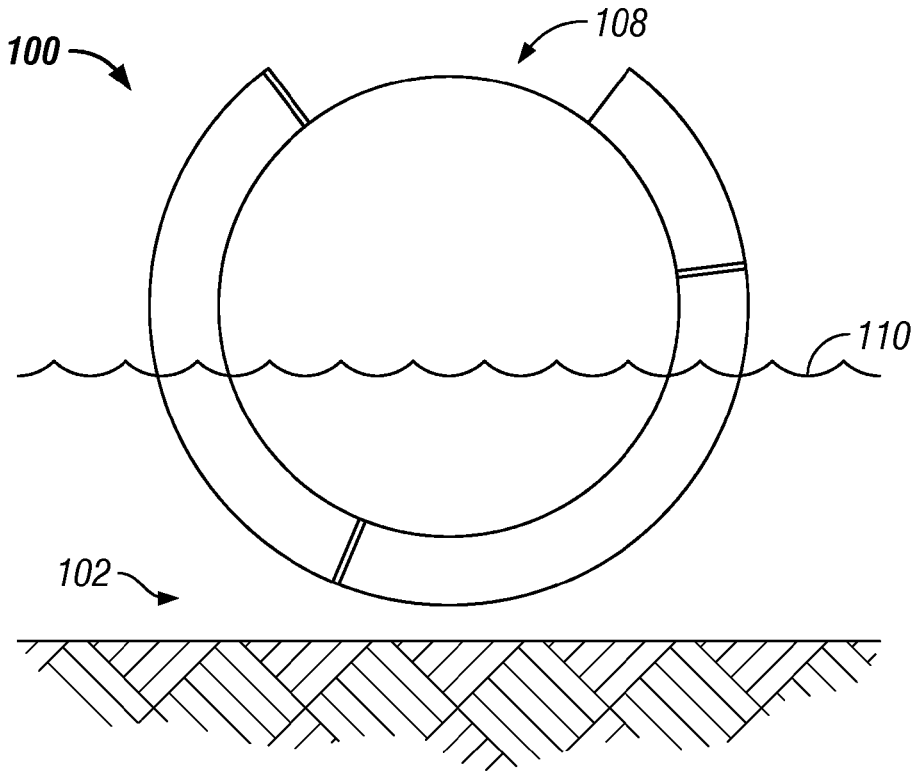
FIG. 2 illustrates an end view of one of many embodiments of a spar in a working position in a deep water pit and utilizing certain aspects of the present inventions.

FIG. 2 illustrates one of many embodiments of spar 100 in a working position in a deep water pit 102 and utilizing certain aspects of the present inventions. Spar 100 may be rotated, such as while floating in deep water pit 102, into one or more working positions, such as that position shown in FIG. 2. For example, spar 100 may be rotated so that belly side 108 is above water line 110, which can allow access to belly side 108, such as for coupling strake 106 thereto or otherwise preparing spar 100 for transport or operations in accordance with a particular application.

Figure 3B:
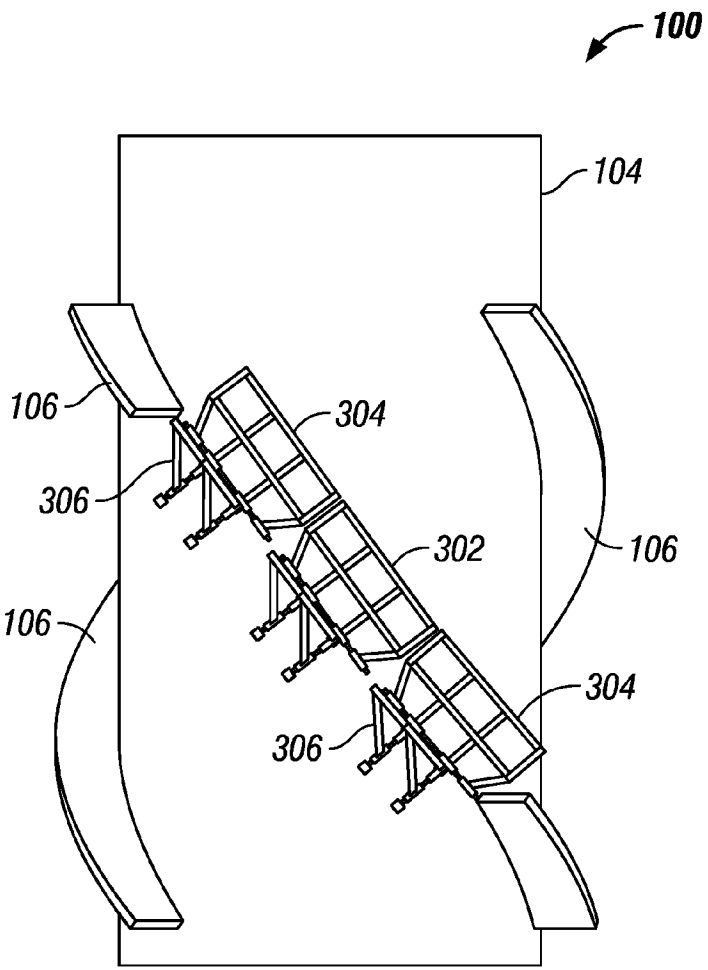
FIG. 3 illustrates an end view of one of many embodiments of a spar having folded belly strakes and utilizing certain aspects of the present inventions.
Figure 3A:
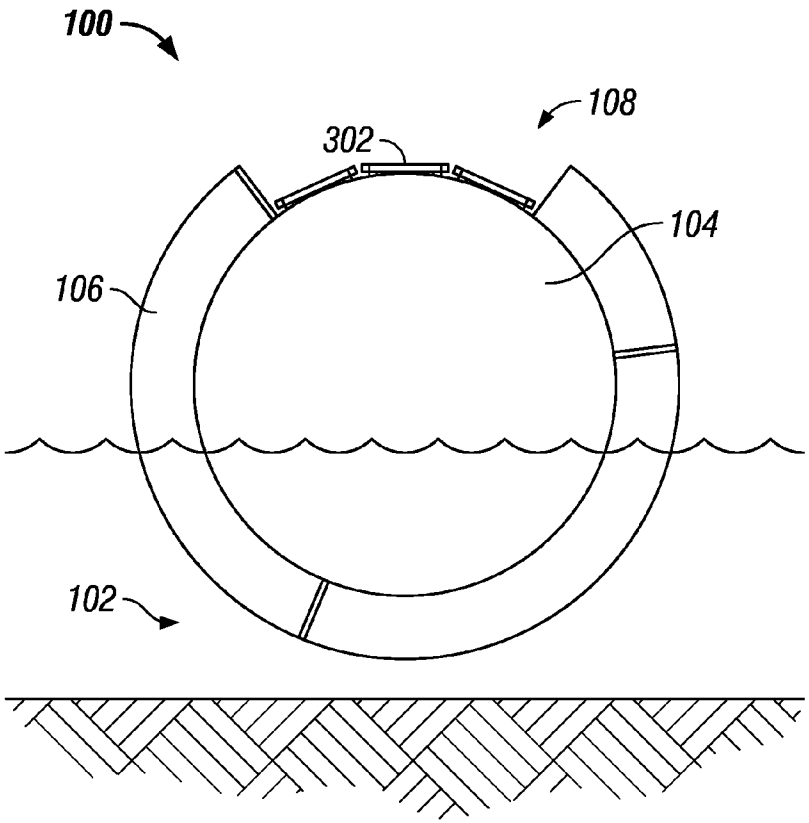

FIG. 3 illustrates one of many embodiments of a spar 100 having folded belly strakes and utilizing certain aspects of the present inventions. As described above, spar 100 may be rotated in tank 102 to allow access to belly side 108 for working or constructing thereon. As shown in FIG. 3, among others, strake 106 and folding strake 302 can be coupled to hull 104 while spar 100 is in the working position. While the working position is shown in FIGS. 2 and 3 to include belly portion facing substantially straight up, the working position may be canted or tilted in any direction in accordance with a particular application. The rightmost figure in FIG. 3 shows strake 106, which is shown to be, but need not be, fixed strake, as well as folding strake 302. Folding strake 302 can include any number of components required by a particular application and can include one or more panels 304 and one or more support frames 306. In at least one embodiment, the present inventions can allow both the folded support frames 306 and folded strake panels 302 to be unfolded in the deep water pit, such as to perform SITs. Once the support frames 306 are formed or fitted for the strake panels 302, which can include installing bolts on the support frame, the strake supports and panels can be, for example, folded to and tied to the hard tank with temporary sea fastening.

Figure 4:
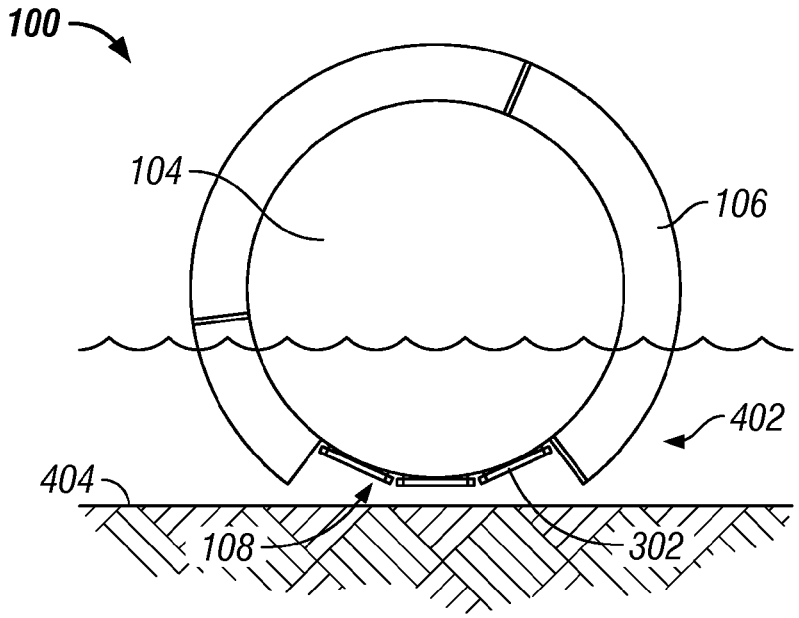
FIG. 4 illustrates an end view of one of many embodiments of a spar having folded belly strakes in a towing position and utilizing certain aspects of the present inventions.

FIG. 4 illustrates one of many embodiments of a spar 100 having folded belly strake 302 in a towing position and utilizing certain aspects of the present inventions. Once folding strake 302 is coupled to spar 100, for example, spar 100 can be rotated to a transport or towing position, such as the position shown in FIG. 4. Alternatively, folding strake 302, or one or more components thereof, can be fitted to spar 100 in the working position and removed before transport, such as to be reinstalled once spar 100 reaches its final or operations location. Folding strake 302 can have any number of folded or unfolded positions required by a particular application, and may preferably include a folded position for towing. For example, folding strake 302 can be temporarily coupled in a folded position relative to the fixed strake 106 or the outer surface of hull 104 so that spar 100 can be towed, for example, through a relatively shallow draft 402, such as a draft 402 having a floor 404 that the fixed strake 106 would drag against if spar 100 were to be towed in a position other than belly side 108 down. In this manner, folding strake 302 can remain in one of many folded positions throughout transport, which may reduce or eliminate the time and costs of dry towing, such as using a HLV.

Figure 5:
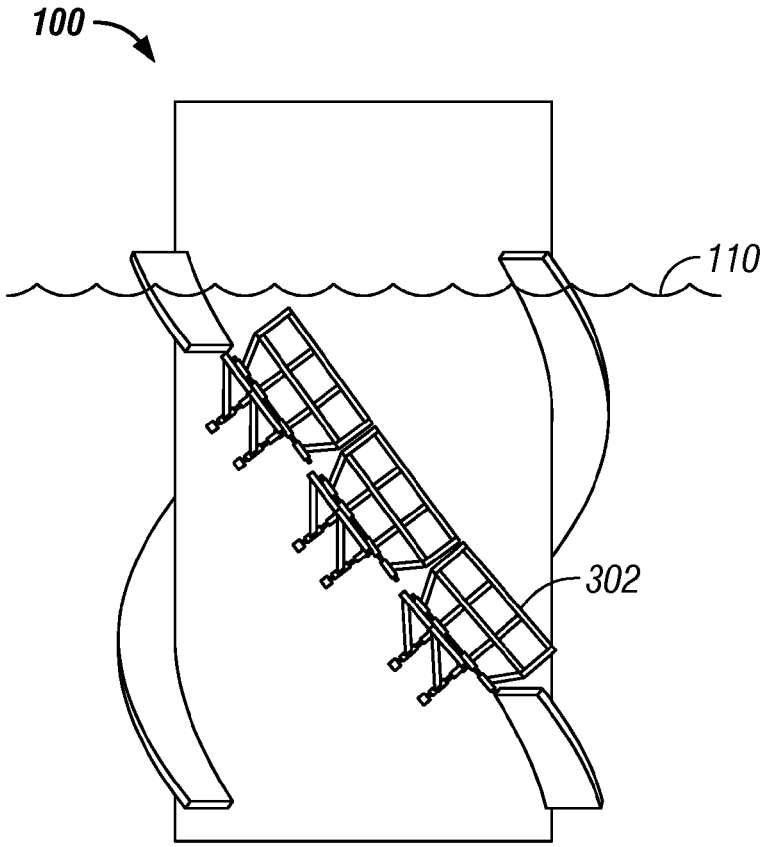
FIG. 5 illustrates one of many embodiments of an upended spar having folded belly strakes and utilizing certain aspects of the present inventions.

FIG. 5 illustrates one of many embodiments of an upended spar 100 having folded belly strakes 302 and utilizing certain aspects of the present inventions. Once spar 100 has been transported or towed to a particular location, such as the location for operations required by a particular application, spar 100 may be upended, or is turned such that its longitudinal axis is perpendicular, or substantially perpendicular, to waterline 110. While folding strake 302 is shown in FIG. 5 to remain under water when spar 100 is upended, folding strake 302 need not. Folding strake 302 may be above water, in whole or in part, and may be coupled at one or more locations along the length of hull 104.

Figure 7:
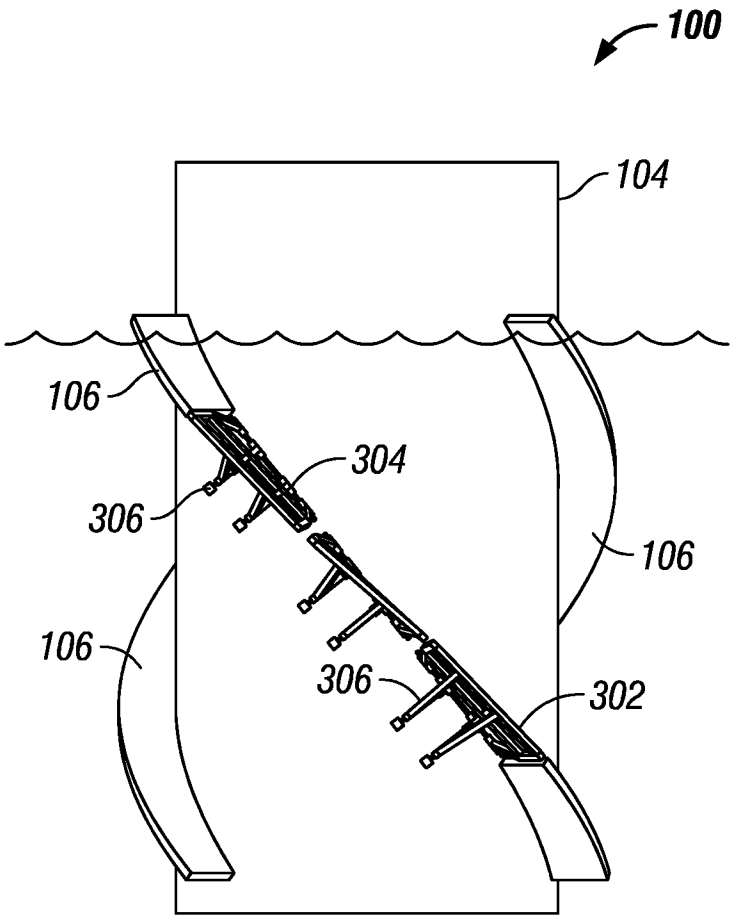
FIG. 7 illustrates one of many embodiments of a spar having unfolded strake panels and utilizing certain aspects of the present inventions.
Figure 6:
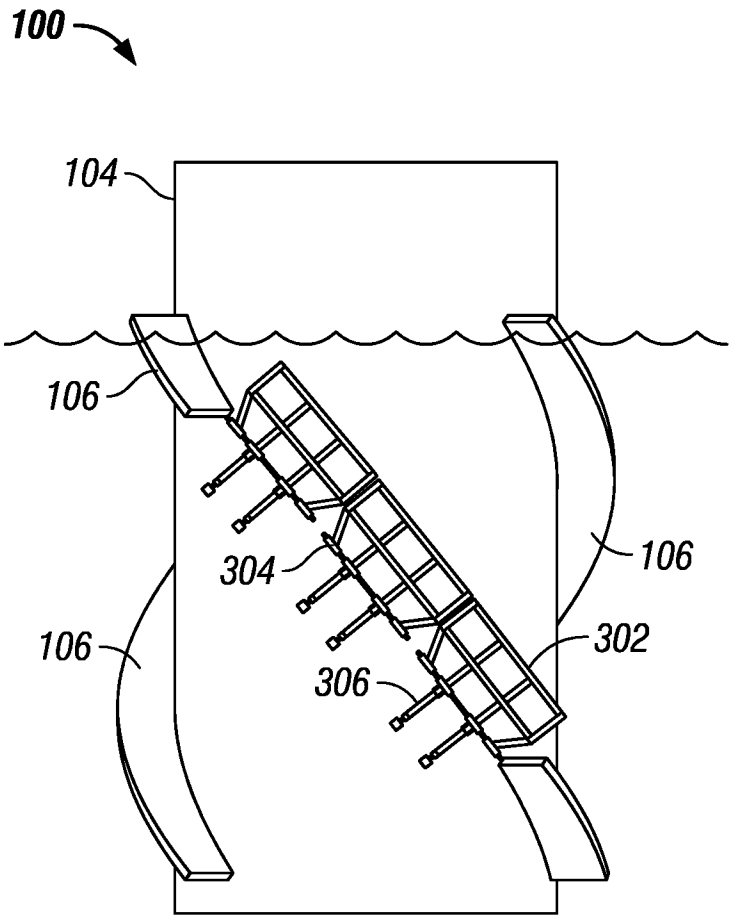
FIG. 6 illustrates one of many embodiments of a spar having unfolded strake support frames and utilizing certain aspects of the present inventions.

FIG. 6 illustrates one of many embodiments of spar 100 having unfolded strake support frames 306 and utilizing certain aspects of the present inventions. FIG. 7 illustrates one of many embodiments of a spar hull having unfolded strake panels and utilizing certain aspects of the present inventions. FIGS. 6 and 7 will be described in conjunction with one another. Once spar 100 is in the upended position, for example, folding strake 302 can be unfolded and coupled into a working position for operations, as required by a particular application. For example, one or more strake panels 304 and/or support frames 306 can be unfolded, such as by hinges, and can include welding, bolts, nuts, or other coupling devices and methods as will be understood by one of ordinary skill in the art. The unfolding and coupling can occur in any manner and in any sequence required by a particular application, including simultaneously. For example, support frames 306 can, but need not, be unfolded first, followed by strake panels 304. Panels 304 can, but need not, be coupled to frames 306, hull 104, or other components of spar 100, separately or in combination. Also, one or more panels 304 or frames 306 can be coupled to the fixed strake 106, separately or in combination with other components. Any number of panels 304 or frames 306 can be coupled to spar 100, including one large frame 306 or one large panel 304. In other embodiments, each panel 304 or frame 306 can be separate, or formed separately and coupled together, as required by a particular application. Folding strake 302 can be coupled in any unfolded position and, while the coupling can occur while spar 100 is in the upright or upended position, it need not, and may occur while spar 100 is in the towing or horizontal position (see, e.g., FIG. 4). Also, the unfolding, positioning, or coupling of strake 302 can be carried out in any manner required by a particular application, such as, for example, by hand, divers or, as another example, by ROVs.

Figure 8A:
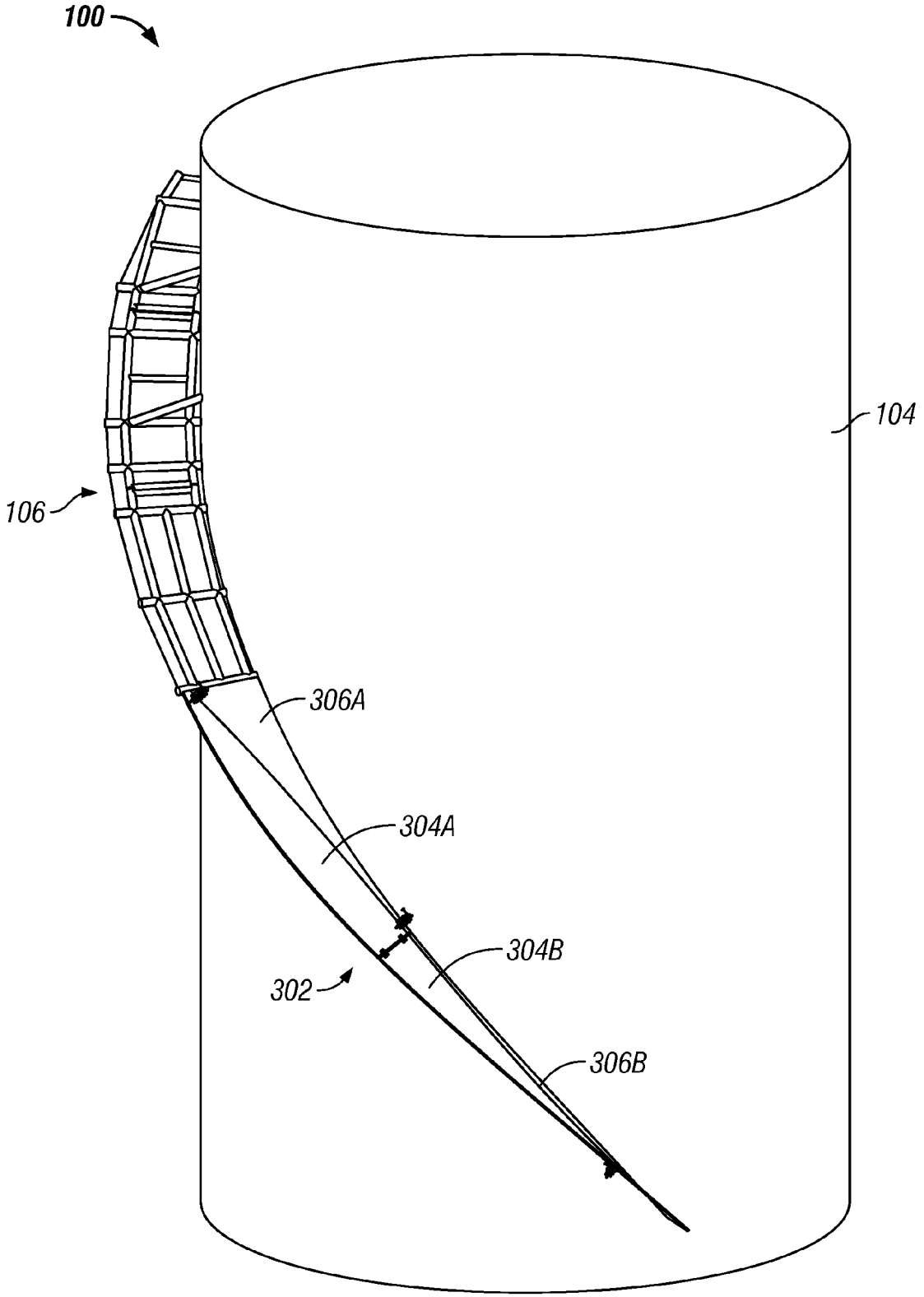
FIG. 8A illustrates one of many embodiments of a spar having unfolded belly strakes and utilizing certain aspects of the present inventions.
Figure 8B:
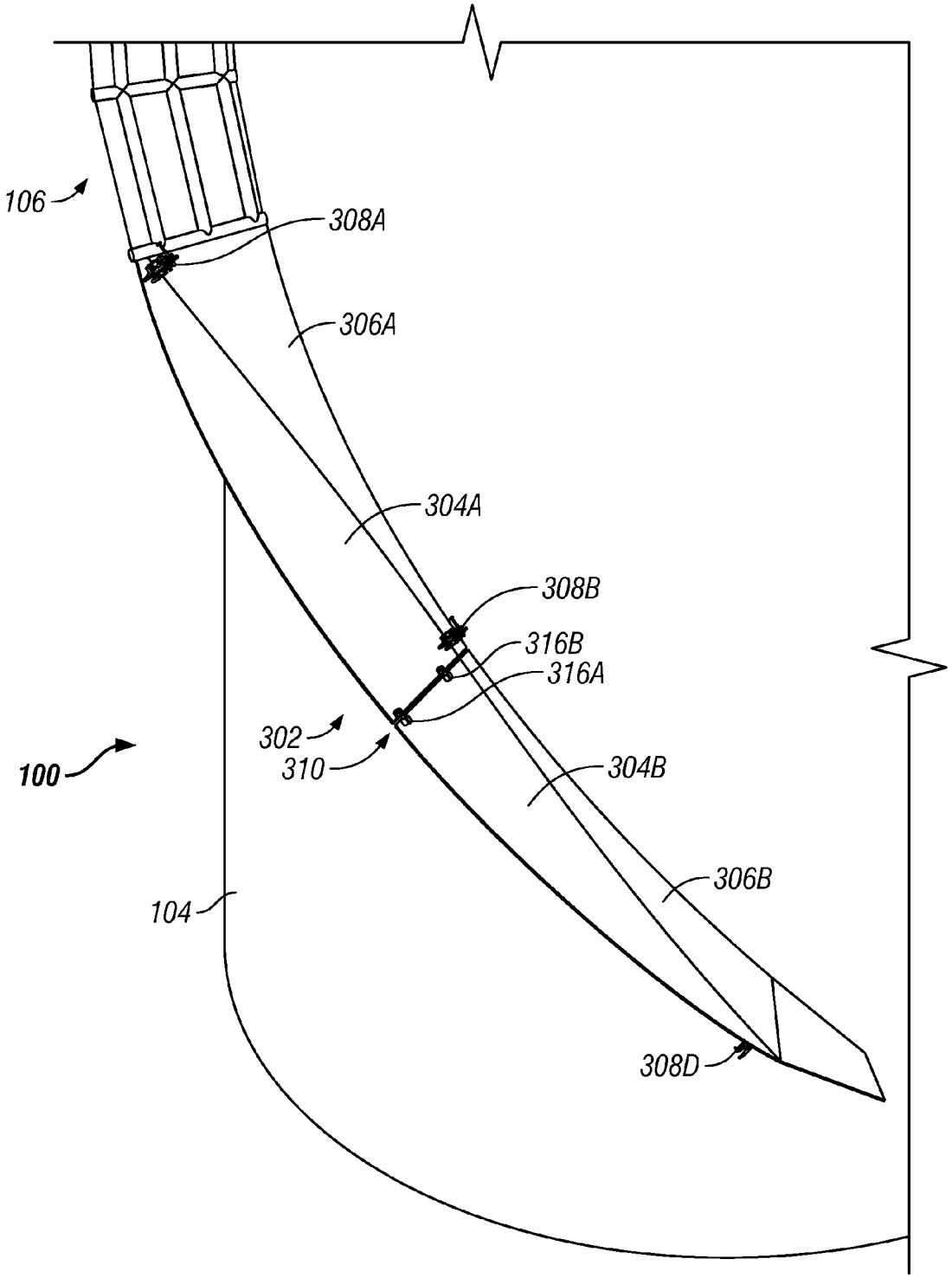
FIG. 8B illustrates an enlarged view of the embodiment shown in FIG. 8A and utilizing certain aspects of the present inventions.
Figure 8C:
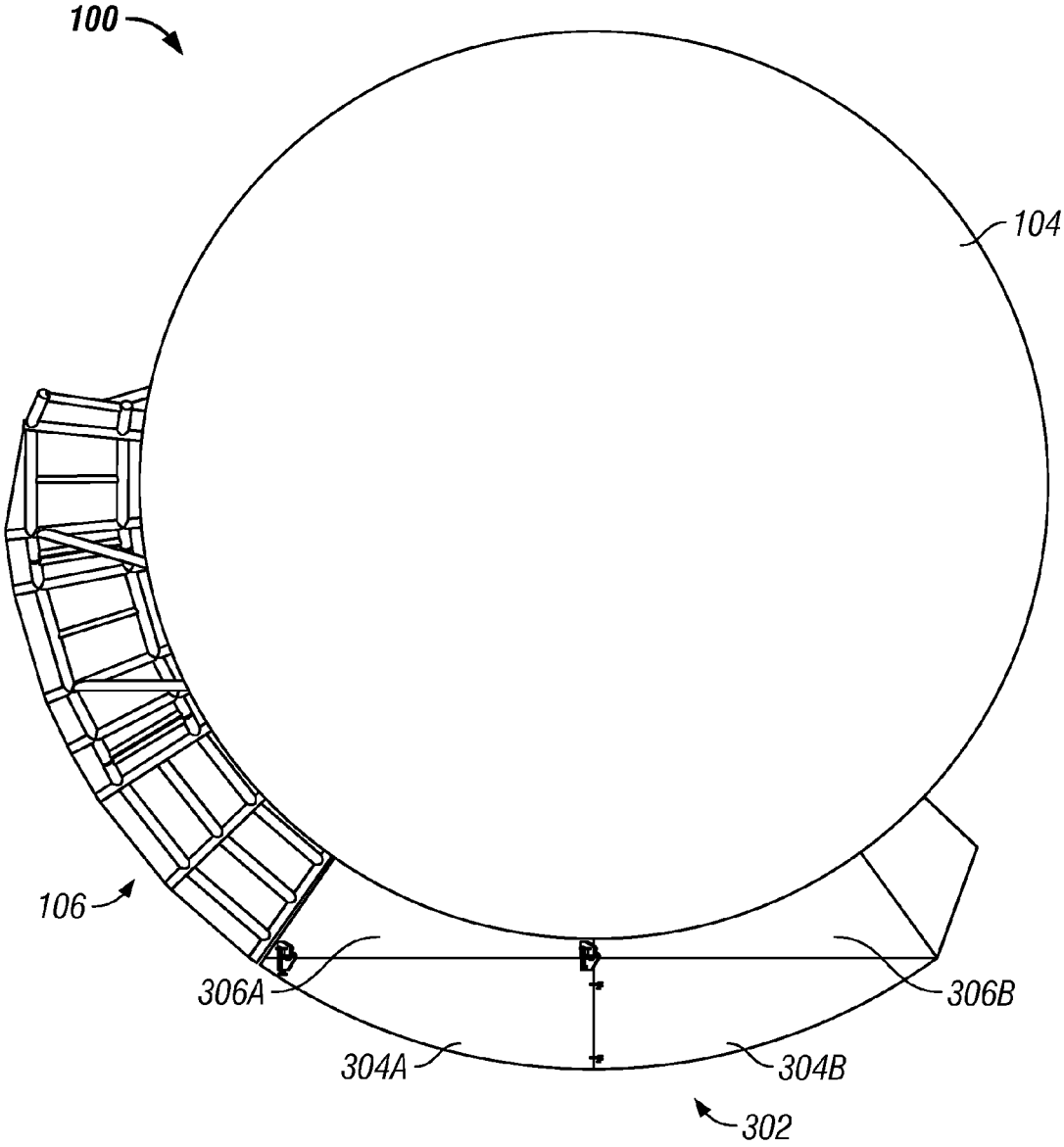
FIG. 8C illustrates an end view of the embodiment shown in FIGS. 8A-8B and is utilizing certain aspects of the present inventions.

FIG. 8A illustrates one of many embodiments of a spar having unfolded belly strakes and utilizing certain aspects of the present inventions. FIG. 8B illustrates an enlarged view of the embodiment shown in FIG. 8A and utilizing certain aspects of the present inventions. FIG. 8C illustrates an end view of the embodiment shown in FIGS. 8A-8B and utilizing certain aspects of the present inventions. The figures will be described in conjunction with each other. The spar 100 can have a strake 106 that is relatively fixed in position and a folding strake 302 that typically will be disposed on the belly side 108 described above. Generally, the folding strake 302 includes one or more folding panels 304 that are hingeably coupled to one or more fixed frames 306. The one or more frames 306 are generally fixedly coupled to the hull 104, and the folding panels can be folded and unfolded relative to the frames. In this embodiment, the frames 306 can form a fixed strake surface that in conjunction with the strake panels deployed in an unfolded position collectively form a combined strake surface along the hull 104. While the illustrated embodiment shows two folding panels with two fixed frames, the number of folding panels can vary from one to many and the illustration is only exemplary.

More particularly, the folding strake 302 includes a first panel 304*a* coupled to a first frame 306A, and a second panel 304B coupled to a second frame 306B. The frames 306A, 306B can be fixed coupled to the hull 104. The panel 304A, 304B can collectively be referred to as panel 304 herein, and frames 306A, 306B can collectively before referred to as frame 306. As will be described below in more detail, the panel 304A can fold in one direction and the panel 304B can fold in a different, such as opposite, direction. For example, the panel 304A can fold upward in the orientation shown in FIG. 8A and the panel 304B can fold downward in the orientation shown in FIG. 8A. To allow the folding, one or more hinges 308A-308D (collectively referred to as hinge 308) can be used. In the illustration, the hinge 308A and the hinge 308B can rotatably couple the panel 304A to the frame 306A. Likewise, the hinge 308C (shown below in FIG. 9A, but hidden in view of the FIG. 8B) and the hinge 308D can rotatably couple the panel 304B to the frame 306B. When the panels are in an unfolded deployed state for functioning as a strake surface, the panels can be coupled together at an interface 310 through one or more couplers 316A, 316B (collectively referred to as coupler 316), as detailed below.

Figure 9A:
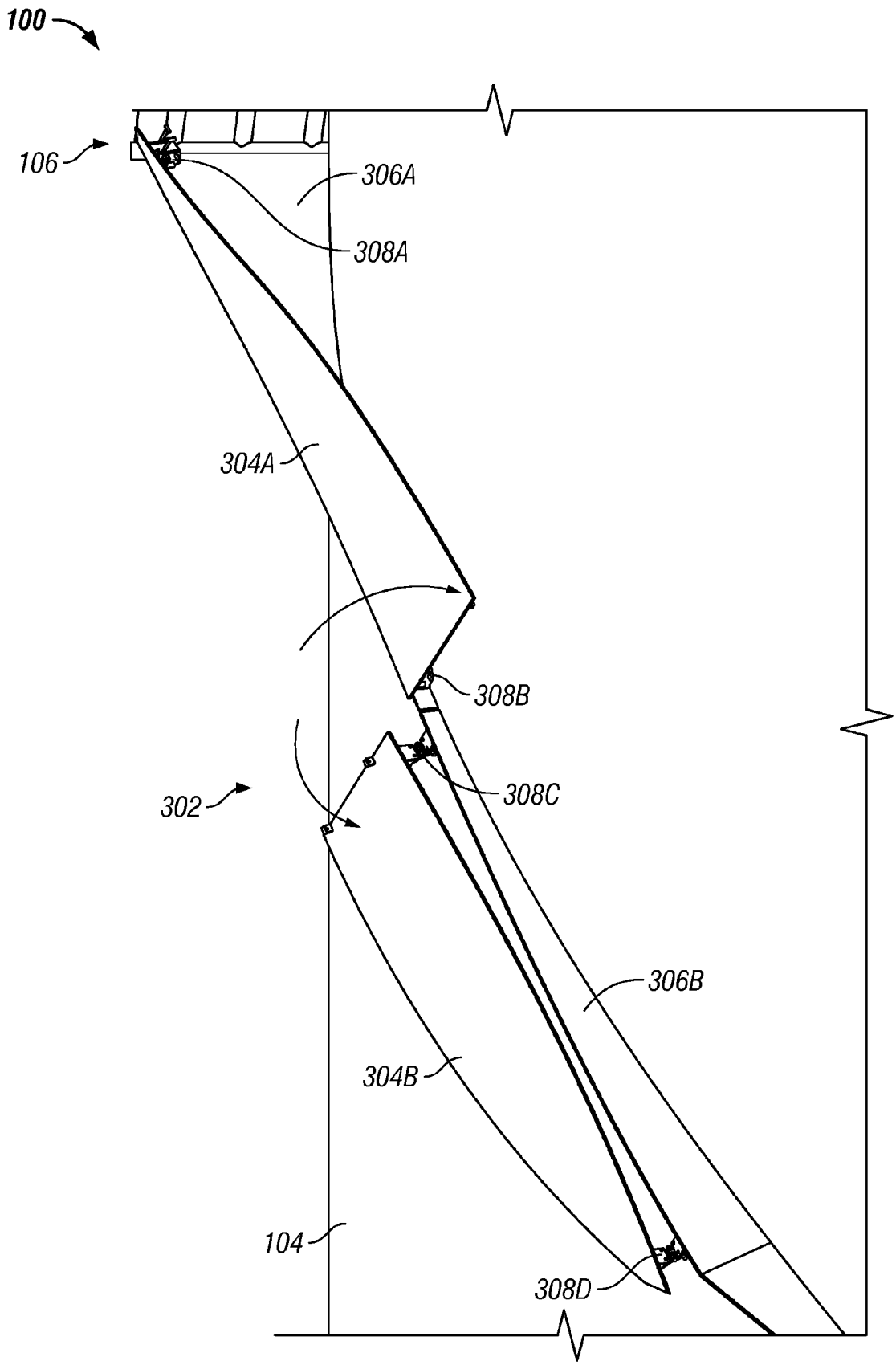
FIG. 9A illustrates the embodiment shown in FIGS. 8A-8C with the strake panels folded and utilizing certain aspects of the present inventions.
Figure 9B:
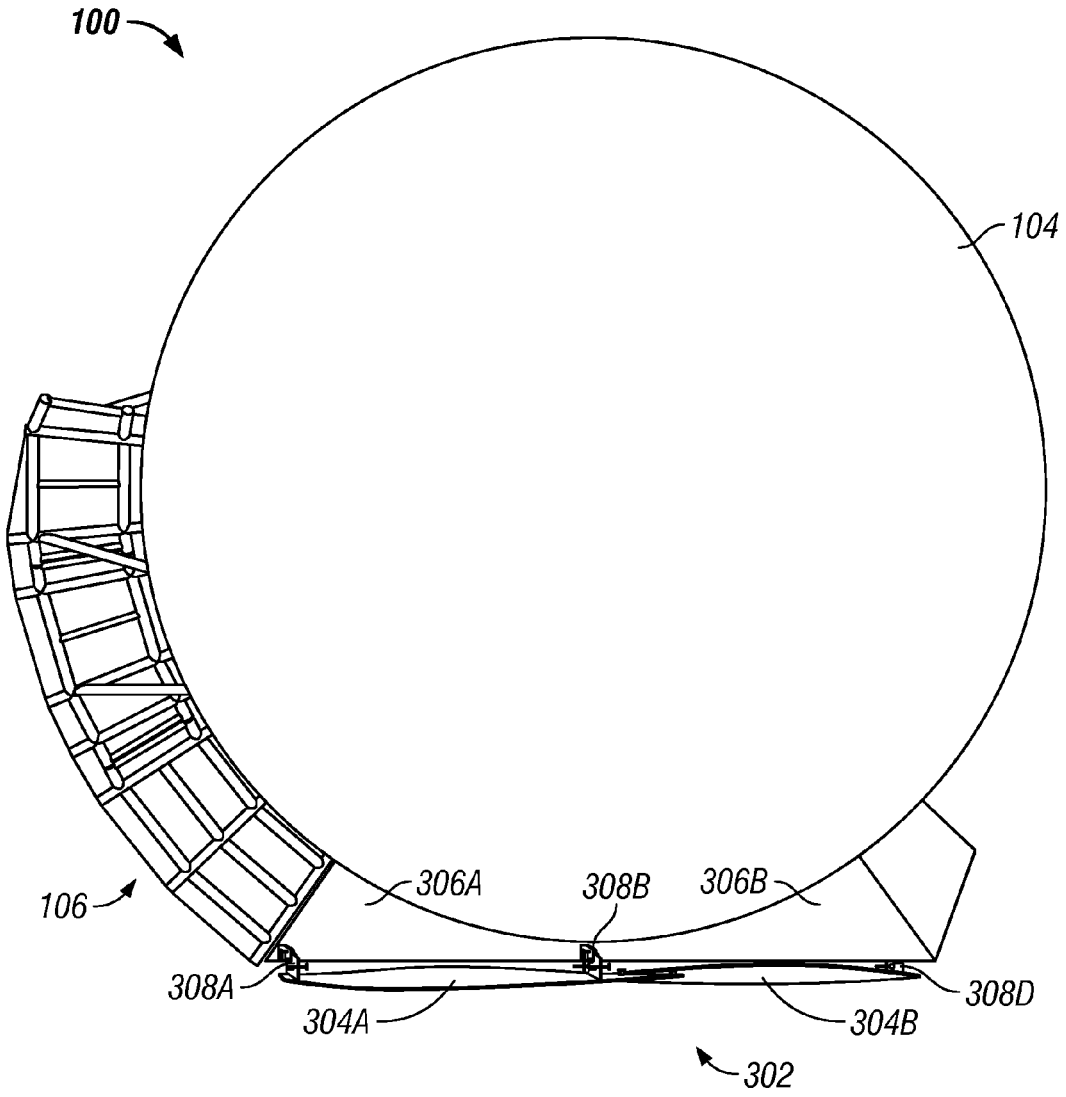
FIG. 9B illustrates an end view of the embodiment shown in FIG. 9A with the strake panels folded and utilizing certain aspects of the present inventions.
Figure 9C:
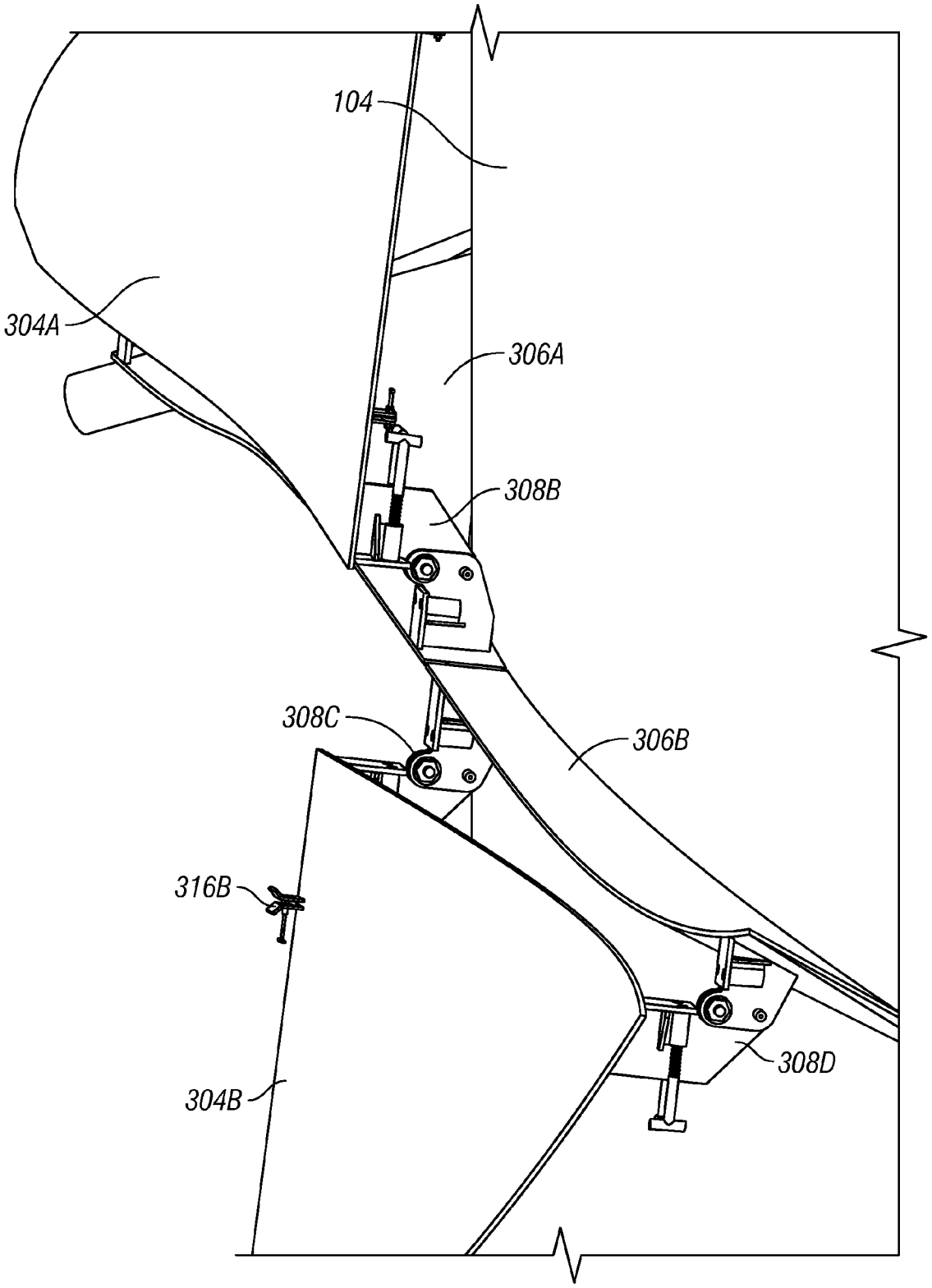
FIG. 9C illustrates an enlarged view of the embodiment shown in FIGS. 9A-9B at an interface between the strake panels with the strake panels being supported by hinges in a folded position and utilizing certain aspects of the present inventions.

FIG. 9A illustrates an enlarged view of the embodiment shown in FIGS. 8A-8C with the strake panels folded and utilizing certain aspects of the present inventions. FIG. 9B illustrates an end view of the embodiment shown in FIG. 9A with the strake panels folded and utilizing certain aspects of the present inventions. FIG. 9C illustrates an enlarged view of the embodiment shown in FIG. 9A at an interface between the strake panels with the strake panels being supported by hinges in a folded position and utilizing certain aspects of the present inventions. The figures will be described in conjunction with each other. As described above, the panel 304A can be rotated to a folded position, such as upward relative to the orientation of the assembly illustrated in FIG. 9A. Similarly, the panel 304B can be rotated downwardly in the orientation shown in FIG. 9A. The hinges 308A, 308B can rotatably support the panel 304A to the frame 306A. Similarly, the hinges 308C, 308D can rotatably support the panel 304B to the frame 306B. While the panels are shown rotated in opposite directions, it is to be understood that in other embodiments, the panels can be rotated in the same direction, subpanels of such panels can be rotated in various directions, and other arrangements so that the panels can be rotated to reduce the strake profile on the hull 104 as described above and further illustrated in FIG. 9B.

Figure 10A:
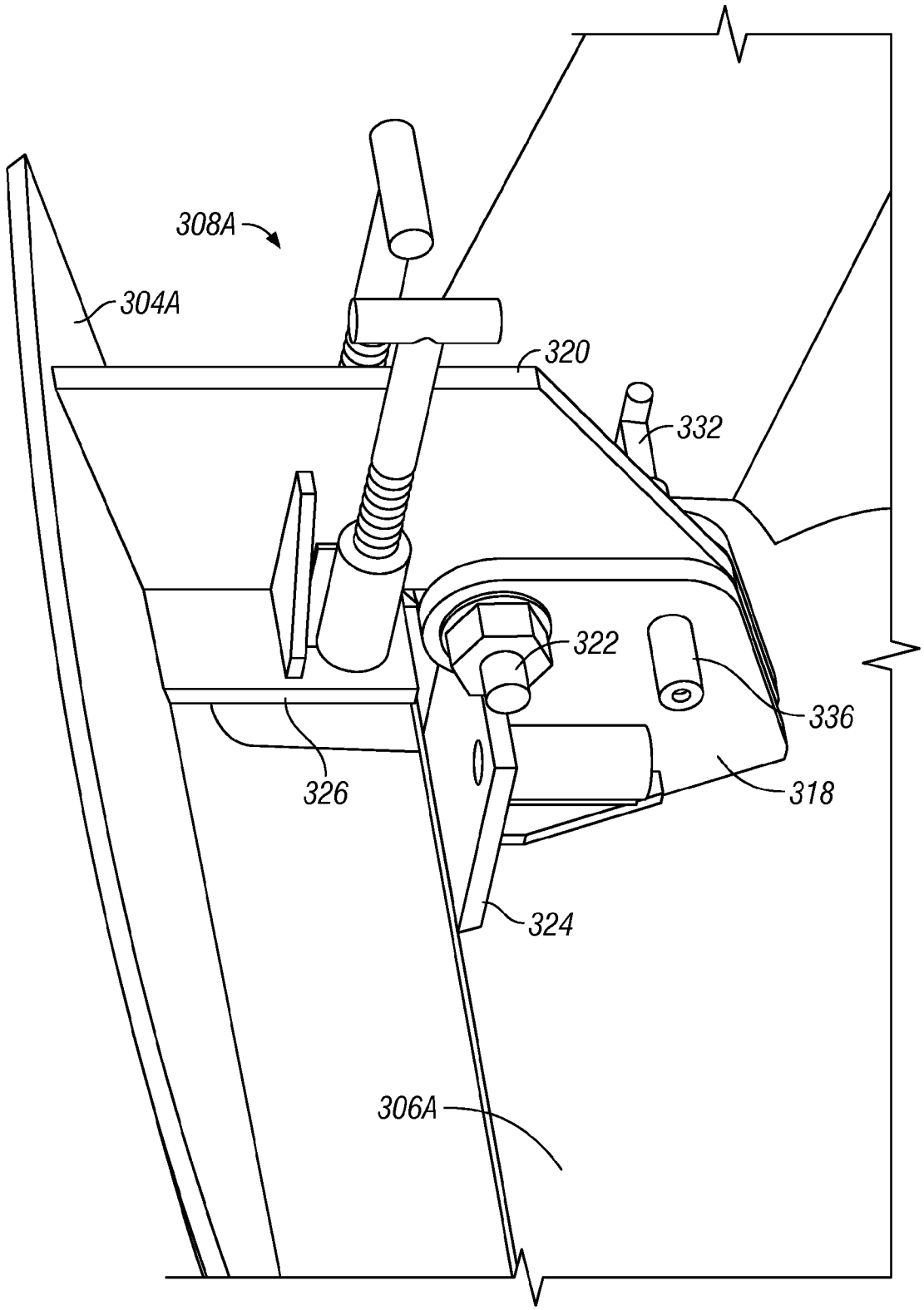
FIG. 10A illustrates one of many embodiments of a hinge in a folded position used with a folding strake panel and utilizing certain aspects of the present inventions.
Figure 10B:
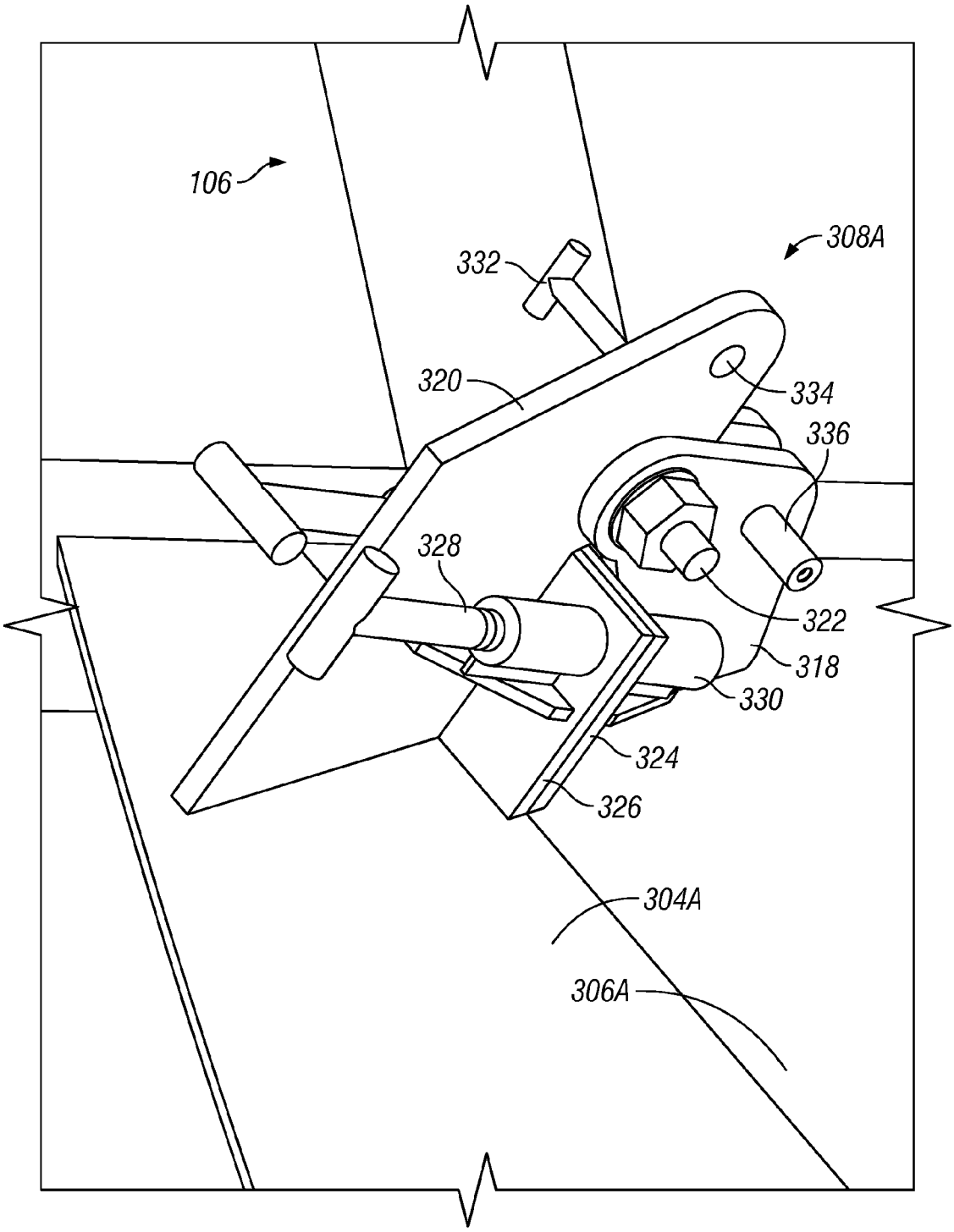
FIG. 10B illustrates the hinge embodiment shown in FIG. 10A in an unfolded position used with the folding strake panel and utilizing certain aspects of the present inventions.

FIG. 10A illustrates one of many embodiments of a hinge in a folded position used with a folding strake panel and utilizing certain aspects of the present inventions. FIG. 10B illustrates the hinge embodiment shown in FIG. 10A in an unfolded position used with the folding strake panel and utilizing certain aspects of the present inventions. The figures will be described in conjunction with each other. The hinge 308A is illustrative of one of many embodiments that can be used to rotatably couple the panel 304A to the frame 306A. The hinges 308B-308D can, but need not, be similarly constructed. The hinge 308A includes a first portion 318 that is fixedly coupled to the frame 306A. The hinge further includes a second portion 320 that is fixedly coupled to the panel 304A. The second portion 320 is rotatably coupled with the first portion 318 by the pivot 322 and can rotate about the pivot 322 relative to the first portion 318. When the panel 304A is in a folded position as illustrated in FIG. 10A, the panel can be retained in the folded position by retaining the second portion 320 with a fastener 332 that engages with the first portion 318. The fastener 332 can be inserted through an opening 334, shown in FIG. 10B, so that the second portion 320 is locked in a folded position relative to the first portion 318. A receiver 336 can also be used to help the fastener 332 maintain the folded position of the panel 304A. To deploy the panel 304A to an unfolded position, the fastener 332 can be removed from engaging the opening 334 of the second portion 320 to allow the second portion 320 to rotate about the pivot 322.

A face plate 324 is coupled to the first portion 318 and a second face plate 326 is coupled to the second portion 320 of the hinge 308A. The face plates can be used to restrict rotation in an unfolded state as described below. When the panel 304A is unfolded to a deployed position, a pair of face plates 324, 326 can contact each other to assist in restricting further rotation of the panel 304A. The hinge 308A can be locked in the deployed, unfolded position by one or more fasteners 328. The fastener 328 can be inserted from the second portion 320 to the first portion 318 of the hinge 308A. A receiver 330 can be used to further secure and provide structural support for the fastener 328 to engage the first portion 318. In at least one embodiment, the fastener can be threaded so that by turning the fastener 328, such as with an ROV, the fastener 328 can engage a suitably threaded receiver 330 to lock the second portion 320 to the first portion 318 of the hinge 308A and secure the panel 304A in the unfolded position.

Figure 10C:
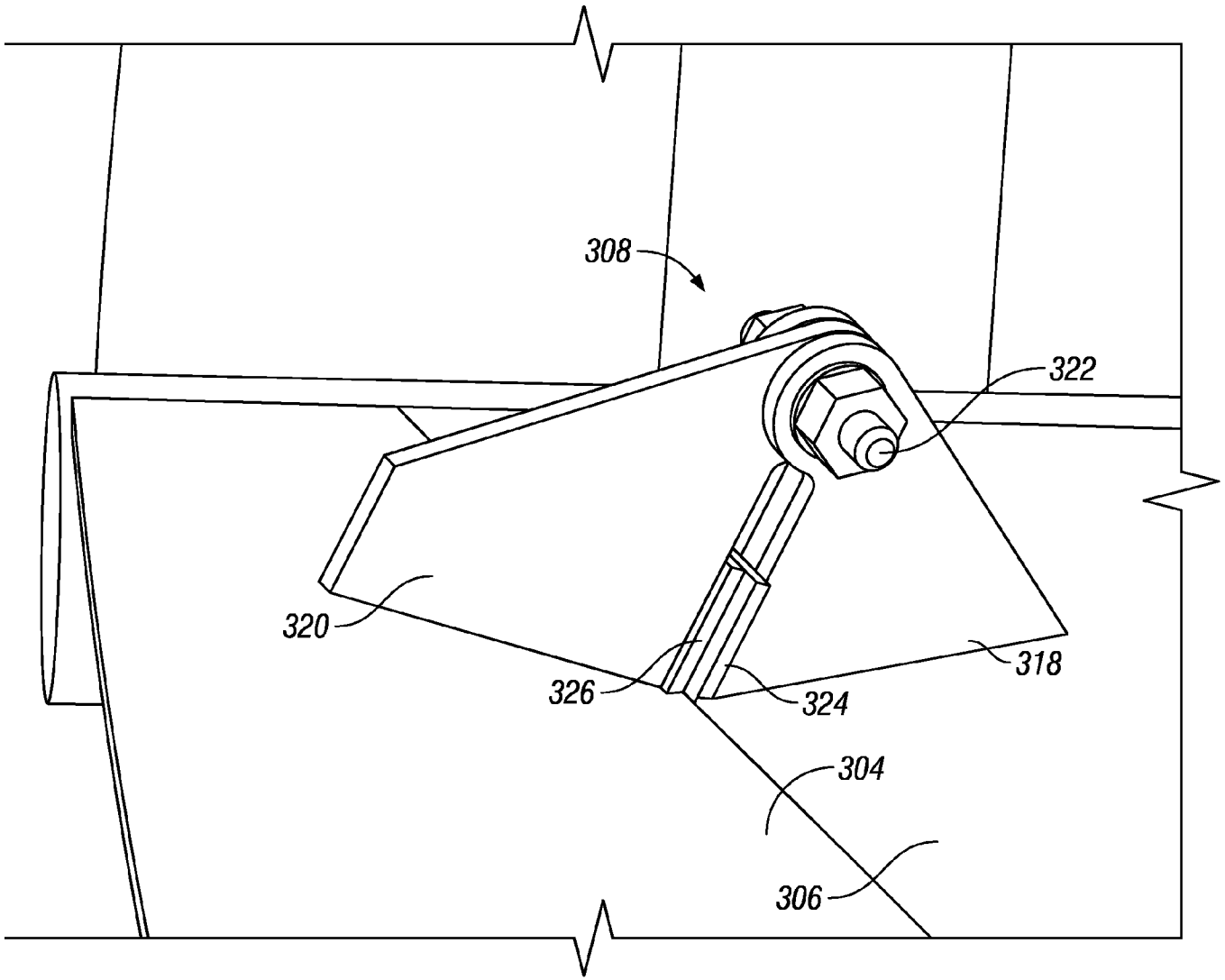
FIG. 10C illustrates another of many embodiments of a hinge in an unfolded position used with a folding strake panel and utilizing certain aspects of the present inventions.

FIG. 10C illustrates another of many embodiments of a hinge in an unfolded is position used with a folding strake panel and utilizing certain aspects of the present inventions. A first portion 318 of a hinge 308 is coupled to a frame 306 and a second portion 320 of the hinge is coupled to a panel 304. The second portion 320 rotates about a pivot 322 relative to the first portion 318. The face plates 324, 326 can, but need not, be used to restrict a maximum movement of the hinge's first and second portions when the panel 304 is in a deployed, unfolded position. The hinge 308 of FIG. 10C does not include components to lock the hinge in an open or closed position corresponding to the folded and unfolded orientations of the panel 304. This hinge design can be used alone or in combination with other hinge designs. In some embodiments, it may be useful to have such hinges at different locations between the panel 304 and the adjacent frame 306 to assist in supporting the components while at the same time using hinges such as those shown in FIGS. 10A-10B to help secure the panels in one or more positions.

Figure 11A:
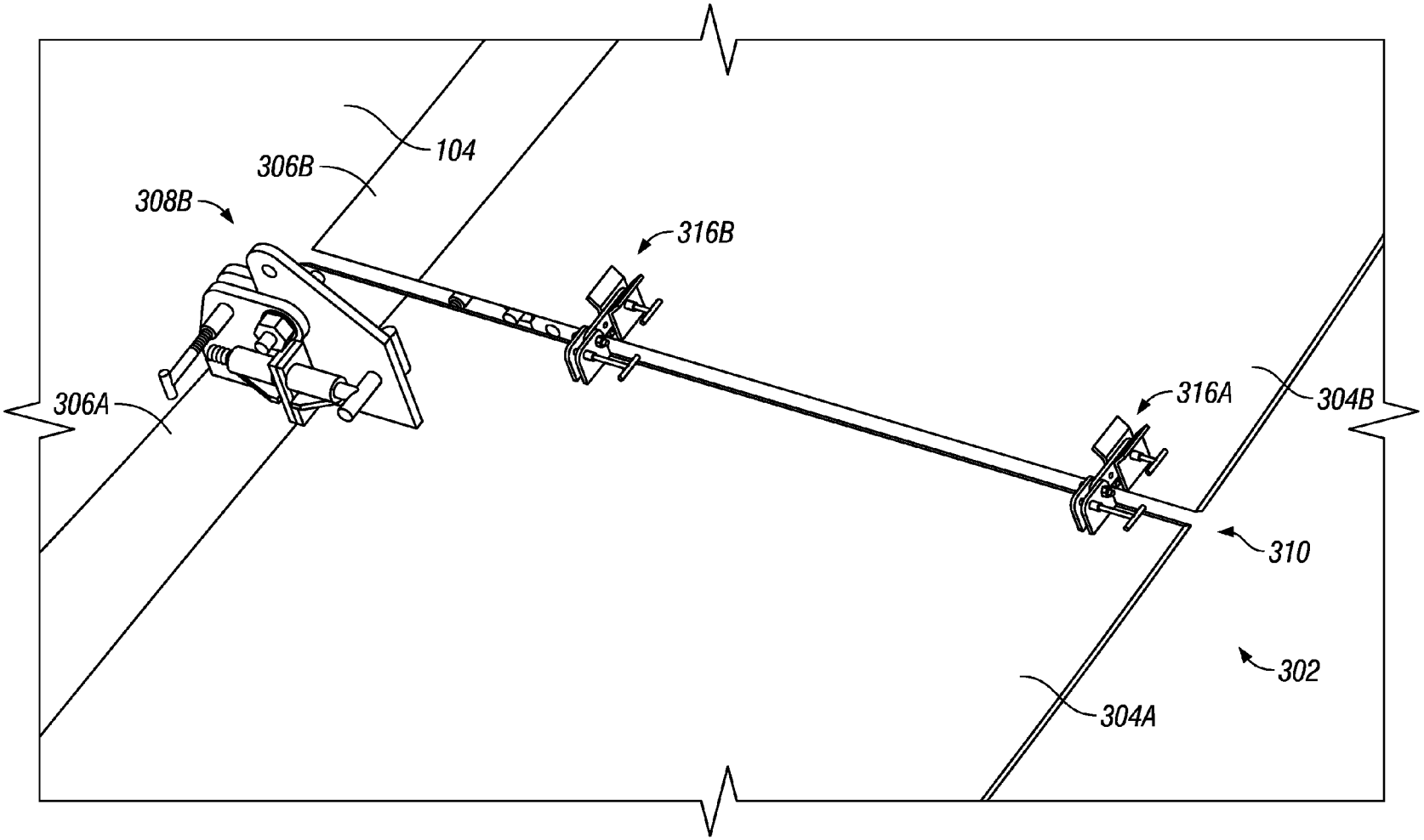
FIG. 11A illustrates one of many embodiments of a coupler used to couple adjacent folding strake panels at an interface between the panels and utilizing certain aspects of the present inventions.
Figure 11B:
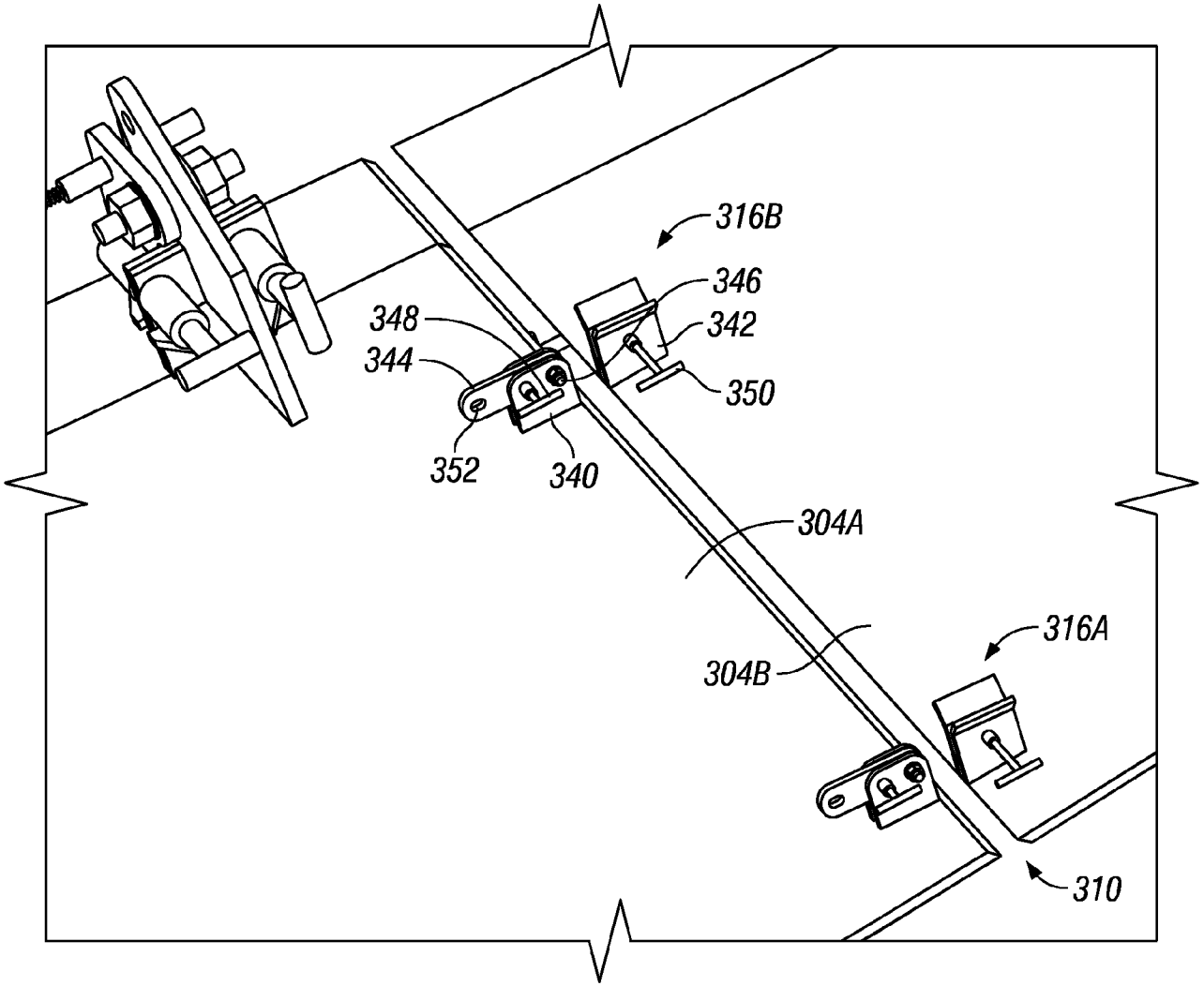
FIG. 11B illustrates an enlarged view of the coupler embodiment shown in FIG. 11A in an uncoupled state and utilizing certain aspects of the present inventions.

FIG. 11A illustrates one of many embodiments of a coupler used to couple adjacent folding strake panels at an interface between the panels and utilizing certain aspects of the present inventions. FIG. 11B illustrates an enlarged view of the coupler embodiment shown in FIG. 11A in an uncoupled state and utilizing certain aspects of the present inventions. The figures will be described in conjunction with each other. When multiple panels are used for the folding strake 302, it can be advantageous to couple the panels together at their interface. In the illustration shown, the panel 304A can be coupled to the panel 304B when the panels are in a deployed, unfolded position. The hinge 308B is shown in FIG. 8B as adjacent the interface 310 between the panels 304A, 304B. In FIGS. 11A-11B, the hinge 308B is shown in a deployed, rotated position for unfolding the panel 304A. Similarly, the hinges that couple the panel 304B to the frame 306B (in FIG. 11A beneath the panel 304B) are also rotated to allow the panel 304B to be in an unfolded position.

One or more couplers 316 can be used to couple the panels 304A, 304B is together. For example, a first coupler 316A can be used to couple together an outward portion of the panels 304A, 304B that is distal from the hull 104, and a second coupler 316B can be used couple together an inward portion of the panels that is proximal to the hull. The number of couplers can vary from one to many and the illustrated number is only exemplary. In FIG. 11A, couplers are shown engaged with the panels 304A and 304B coupled together. In FIG. 11B, the portions of the coupler are shown uncoupled, and thereby the panels 304A, 304B are also uncoupled. More specifically, as shown in FIG. 11B, the coupler 316B can include a first portion 340 that is coupled to the panel 304A and a second portion 342 that is coupled to the panel 304B. A latch 344 can be rotatably coupled to the first portion 340 about a pivot 346 and can be held in such position by a fastener 348. The second portion 342 of the coupler 316 acts as a receiver and can receive the latch 344, when the latch 344 is rotated toward the second portion 342. A fastener 350 can be inserted through an opening 352 formed in the latch 344, to secure the latch with the second portion 342. The opening is illustrated in FIG. 11B and a secured latch is illustrated in FIG. 11A.

Figure 12:
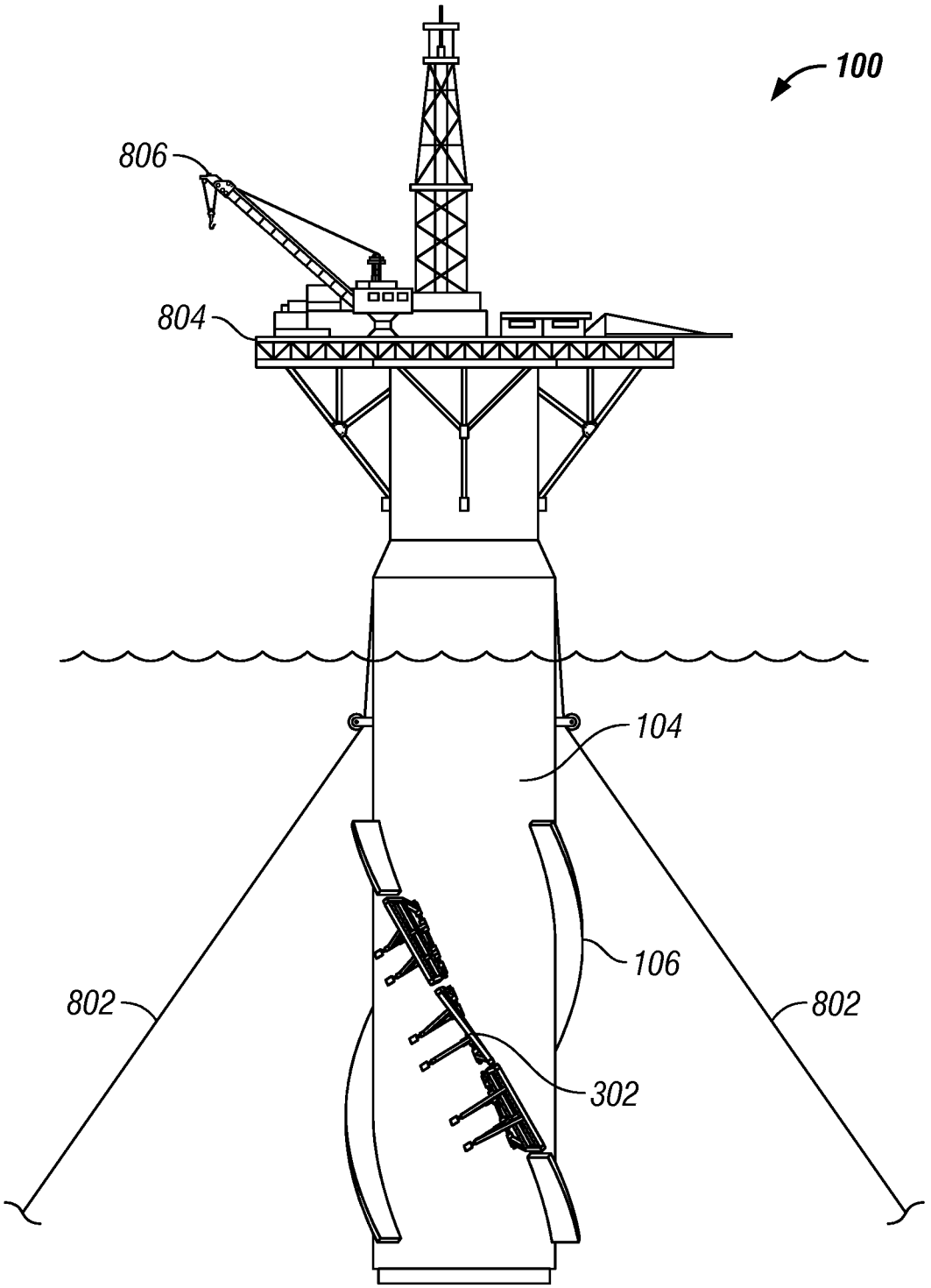
FIG. 12 illustrates one of many embodiments of a spar in an installed position and utilizing certain aspects of the present inventions.

FIG. 12 illustrates one of many embodiments of a spar 100 in an installed position and utilizing certain aspects of the present inventions. Once folding strake 302 is unfolded and coupled as required by a particular application, spar 100 can be positioned for operations, such as, for example, in the final or operations position shown in FIG. 12. For example, moor lines 802 can be coupled to hull 104 or other portions of spar 100, such as to anchor spar 100 to the sea floor. As other examples, one or more decks 804 or cranes 806 can be coupled to spar 100, separately or in combination with any other drilling or operations equipment required by a particular application. While the contour of folding strake 302 is shown in FIG. 12 to match that of fixed strake 106 when strake 302 is in the unfolded position, it need not, and can have any shape or contour required by a particular application. Also, while strakes 106, 302 are shown in FIG. 12 to be coupled in a helical fashion about spar 100, it need not be, and can take any form or fashion.

Other and further embodiments utilizing one or more aspects of the inventions described above can be devised without departing from the spirit of Applicant's invention. For example, all of the strake can be folding strake or the folding strake can be folded or unfolded automatically, such as by pistons. Further, the various methods and embodiments of the spar can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A spar hull for a floating vessel, comprising:

a hard tank having an outer surface, wherein the outer surface has a belly portion;

a fixed strake coupled to a first portion of the outer surface of the tank;

a folding strake coupled to a second portion of the outer surface of the tank different than the first portion, the folding strake having one or more strake panels configured to be selectively folded toward the outer surface of the tank.

2. The spar hull of claim 1, wherein the first portion does not include the belly portion and the second portion includes the belly portion.

3. The spar hull of claim 1, wherein the one or more strake panels are rotatably coupled to the second portion of the outer surface.

4. The spar hull of claim 1, further comprising a locking structure adapted to lock the one or more strake panels in one or more folded or unfolded positions relative to the outer surface of the tank.

5. The spar hull of claim 1, further comprising a support frame configured to be coupled to the side of the spar and having an unfolded and at least one folded position and configured to support the strake panel when the frame and panel are in the unfolded positions.

6. The spar hull of claim 1, further comprising a support frame fixedly coupled to the outer surface and at least one of the strake panels rotatably coupled to the support frame.

7. The spar hull of claim 1, further comprising a support frame fixedly coupled to the outer surface and forming a portion of the folding strake and at least one of the strake panels rotatably coupled to the support frame, the support frame and the folding strake panel forming a strake surface when the folding strake panel is deployed in an unfolded position.

8. The spar hull of claim 1, wherein the folding strake comprises at least two fixedly coupled support frames and at least two strake panels rotatably coupled to the support frames, and a first strake panel being configured to fold in a first direction along the outer surface of the tank and a second strake panel being configured to fold in a second direction different than the first direction.

9. The spar hull of claim 1, further comprising a coupler having a first portion attached to a first strake panel and a second portion attached to a second strake panel, the coupler configured to couple the first and second strake panels together when the panels are in an unfolded position.

10. A method of utilizing a spar hull for offshore oil and gas operations, comprising:

providing a spar hull having a belly strake, wherein at least a portion of the belly strake has at least one folded and unfolded position;

fixing the strake in the folded position;

positioning the spar hull offshore in a transport position;

upending the spar hull;

unfolding the strake;

fixing the strake in the unfolded position; and positioning the spar hull in an installed position.

11. The method of claim 10, further comprising installing the belly strake on the spar hull, comprising:

rotating the spar hull so that a belly side of the spar hull is in a first workable position;

coupling at least one folding strake of the belly strake to the belly side of the spar hull.

12. The method of claim 11, further comprising transporting the spar hull to a work pit prior to rotating the spar to the first workable position and rotating the spar hull to a second position for wet tow.

13. The method of claim 10, wherein the belly strake comprises one or more strake support frames and one or more strake panels and further comprising:

fitting the support frames and the strake panels to the spar hull;

temporarily removing one or more of the support frames or panels for transport to a location for operations.

14. The method of claim 10, wherein fixing the strake in the folded position comprises:

folding a first strake panel in a first direction along the outer surface of the tank; and folding a second strake panel in a second direction different than the first direction.

15. The method of claim 10, further comprising coupling a first strake panel of the belly strake to a second strake panel of the belly strake at an interface between the strake panels when the strake panels are unfolded.

16. A spar hull for a floating vessel, comprising:

a hard tank having an outer surface, wherein the outer surface has a belly portion;

a fixed strake coupled to a first portion of the outer surface of the tank, the fixed strake including one or more fixed strake sections extending radially outwardly from the first portion of the outer surface of the tank;

a folding strake coupled to a second portion of the outer surface of the tank different than the first portion, the folding strake including at least one folding strake panel configured to be selectively folded toward the outer surface of the tank; and a support configured to couple to the at least one folding strake panel when the at least one folding strake panel is in an unfolded position, the support being configured to at least temporarily retain the at least one folding strake panel in the unfolded position.

17. The spar hull of claim 16, wherein the support is selected from the group consisting of a support frame configured to support the at least one folding strake panel from a side, a support frame configured to form a combined strake surface in conjunction with the at least one folding strake panel, and a combination thereof.

18. The spar hull of claim 16, further comprising a plurality of folding strake panels including at least two adjacent folding strake panels, the at least two adjacent folding strake panels being coupled together with one or more couplers at an interface there between.

19. The spar hull of claim 16, wherein the support further comprises a plurality of support frames configured to support the at least one folding strake panel from one side of the at least one folding strake panel.

20. The spar hull of claim 16, further comprising a hinge coupled to the at least one folding strake panel, wherein the hinge is configured to be at least temporarily locked in one or more positions about a pivot.

* * * * *